United States Patent [19]

Smith et al.

[11] 4,083,697

[45] Apr. 11, 1978

[54] COMBUSTIBLE COMPOSITION

[75] Inventors: Thomas F. Smith; Alban Timmons, both of Beverley, England

[73] Assignee: Reckitt & Colman Products Limited, London, England

[21] Appl. No.: 703,911

[22] Filed: Jul. 9, 1976

[30] Foreign Application Priority Data

Jul. 11, 1975 United Kingdom ..... 29172/75

[51] Int. Cl.[2] ..... C10L 7/02

[52] U.S. Cl. ..... 44/7 D; 44/24; 44/25

[58] Field of Search ..... 44/7 D, 7 E, 10 B, 24, 44/25, 27

[56] References Cited

U.S. PATENT DOCUMENTS

| | | | |
|---|---|---|---|
| 827,139 | 7/1906 | Browne | 44/27 |
| 3,615,286 | 10/1971 | Vander Linden | 44/7 D |
| 3,726,651 | 4/1973 | Ronden | 44/24 |
| 3,843,336 | 10/1974 | Messman | 44/25 |

FOREIGN PATENT DOCUMENTS

| | | | |
|---|---|---|---|
| 2,328,631 | 12/1973 | Germany. | |
| 115,645 | 5/1919 | United Kingdom | 44/24 |
| 187,351 | 10/1922 | United Kingdom | 44/24 |

*Primary Examiner*—Edward A. Miller
*Attorney, Agent, or Firm*—Bacon & Thomas

[57] ABSTRACT

Firelighter compositions comprising a hardened emulsion of a hydrocarbon oil such as kerosine in a curable resin such as a urea-formaldehyde resin and having distributed uniformly throughout a particulate solid fuel of particle size distribution such that the preponderance is retained on a sieve of mesh number 35, nominal aperture size 0.44 mm.

29 Claims, No Drawings

COMBUSTIBLE COMPOSITION

This invention relates to combustible compositions more particularly to such compositions for use as firelighters.

Probably the most widely used form of firelighter in recent years has been the so-called "white firelighter" which is easy to manufacture, handle, distribute and is highly effective.

"White firelighter" comprises a block of hardened emulsion of aqueous curable resin and liquid hydrocarbons and may be used for firelighter blocks. White firelighter is prepared from an oil-in-water emulsion, that is where the continuous phase is the aqueous phase and the discontinuous oil phase is a combustible liquid, usually a liquid hydrocarbon. The aqueous phase contains a curable resin so that when the mixture is cured or catalysed, the mass becomes a solid matrix in which the liquid hydrocarbon oil phase is, as it were, encapsulated as discrete globules. A typical cold curing resin is urea-formaldehyde resin and typical liquid hydrocarbons include kerosine. White firelighter compositions may be prepared with a kerosine content in excess of 90 percent by weight of the composition and their efficacy is due to such high kerosine content. Because of the increasing cost of kerosine, white firelighter is becoming a wasteful use of one of the diminishing natural resources namely oil stock.

The introduction of solid combustible materials would appear to afford advantages and economies. It is known however that the emulsion used in the manufacturing process is sensitive to the addition of solids. It has been observed that emulsions of hydrocarbon oil in urea-formaldehyde dispersion have a tendency to break down or separate into layers when solid particulate material is added.

More particularly the present invention provides a combustible composition comprising a matrix of cured resin having distributed therethrough hydrocarbon oil and also particles of solid combustible material in which the particles are of size such that at least 95% thereof are retained on a sieve of mesh number 35 (nominal aperture size 0.44 mm). The solid combustible material used may be at least one of the non-carbonaceous fuels comminuted wood, granulated wood, comminuted peat and granulated peat. The granular peat may have a density of 0.64 to 0.72 g/ml.

The solid combustible material may be wood or peat in comminuted form. Preferably, the wood or peat is a comminuted form that has previously been agglomerated and compressed optionally with addition of such materials as waxes to facilitate agglomeration and is herein referred to as "granulated" solid combustible material.

Like peat, wood is a non-carbonaceous solid fuel in that it has not undergone the metamorphosis characteristic of coal and charcoal.

One preferred combustible material is peat, especially granulated peat that is peat that has been dried and compressed prior to comminution. Such peat may be compressed in ratio of about 4 : 1 or more, preferably 6 : 1 and possibly advantageously 10 : 1.

A particularly useful form of peat is a granular material that is produced from so-called milled peat by drying to a moisture content between 8 and 12 percent, usually 10 percent, compression at 5 tons per square inch pressure, followed by comminution.

Preferably, the particle size of the solid combustible material is such that it is substantially all retained on a sieve of mesh number 35 (nominal aperture size 0.44 mm).

At least 90% of the particles are retained on sieve meshes number 5 to 22 (nominal aperture size 3.35 mm and 0.71 mm), although sieve meshes 6–30 (nominal aperture size 2.80 mm to 0.5 mm) may also be used as may sieve meshes 8 to 30 (nominal aperture size 2.00 mm to 0.5 mm) ideally one would aim to use particles of size such that they are retained on sieve meshes 7 to 14 (nominal aperture size 2.4 mm to 1.8 mm).

It should be appreciated that in practice it is extremely difficult, firstly to produce a sieve fraction exactly conforming to a given specification; secondly on transferring such a precise fraction, if it were obtainable, to the mixture from which the combustible composition is made and during mixture it is inevitable that some attrition occurrs with consequent production of particles of smaller size than in the original sample. So that whilst substantially all (say, at least 95%) of the total solid combustible material is retained on a sieve of mesh number 35, a minor amount of 5% w/w may be of smaller particle size can be tolerated as detailed below. Broadly, the amount of fines expressed as a percentage of the total number of particles will be less, the larger the mean particle size of the solid combustible material.

Fines are regarded as particles of size such that they pass a sieve mesh of number 35 (nominal aperture size 0.44 mm) and grade down to microscopic particles. For the purpose of this invention up to about 5 percent w/w of the solid fuel may be present as fines if the fines are of the order of size that will just pass through a sieve of mesh number 35. If the fines are ultrafines, that is of the order of size that will about pass a sieve mesh number 100 (nominal aperture 150 μm), then about 0.5 percent w/w can be tolerated. Of particles finer than this only 0.1 percent can be tolerated.

The phenomenon of "masking" becomes noticeable with firelighters containing particles which all pass a sieve mesh number 35. "Masking" is that effect which starves the firelighter of air, causes it to burn smokily and in the extreme extinguishes it. A masking effect may be exhibited by combustible compositions containing particulate solid fuels if too much is employed in a composition or if solid fuel of too small a particle size is employed. The phenomenon is characterised by a powdery coating developing upon the surface of a burning block.

Whilst for example, peat in its ordinary form, that is cut, dried and preferably cleaned, may be employed in the present invention after comminution it may not be incorporated into white firelighter composition to the same extent on a weight for weight basis as peat that has been agglomerated and compacted. This is partly a function of bulk density but importantly ordinary peat has a greater tendency to cause breakdown of the emulsion so that the amount that advantageously may be incorporated into white firelighter is limited, for example, up to about 12% w/w based on the final composition.

It is well-known that as commonly employed peat exhibits a burning characteristic which would in a sense make it disadvantageous for use in firelighters. Thus ordinary peat tends to burn either without a flame or with a lazy, discontinous flame that has a tendency to extinguish, whilst the body of the peat may well continue to smoulder and produce useful heat. Such properties carried into a firelighter would not be expected to produce a persistant flame of sufficient length to ignite a bed of solid fuel.

The use of solid combustible material that has been compacted facilitates increasing the proportion by weight thereof that may be introduced into a firelighter block of given size; furthermore, masking is reduced and may be substantially eliminated by careful control of the particle size distribution and the amount added. Loadings of over 5%, say 10% w/w and 15% w/w or more may be included.

As indicated above in relation to the particle size of the solid fuel employed, it is believed that smaller particles contribute disproportionately to the tendency of an emulsion to breakdown in that having a relatively large surface area, they present an extensive interface where breakdown may be initiated. On the other hand incorporating solid combustible material of surface characteristics and particle size in accordance with the present invention, into an emulsion results, in a stable, manageable emulsion.

The practical range of particle size is 0.71 mm to 3.35 mm but larger particles can be used however, where blocks are produced of size such that the blocks require to be cut to sizes suitable for use, cutting is frequently effected with a cutting wire and large particles snag the wire producing untidy cuts and much swarf. This may be overcome to some extent by the use of thin cutting blades intead of wires. Alternatively, swarf production may be overcome by simply moulding blocks to the required size if particles at the upper end of the size range are to be used. Furthermore, if the particles are of such large size their incorporation into white firelighter does not have the desired effect upon the burning characteristics of a firelighter containing them. In such circumstance the firelighter burns essentially as a white firelighter of reduced kerosine content except that upon extinction, smouldering lumps of solid combustible material may remain in the shrivelled matrix of cured resin.

The proportion by weight of particulate solid combustible material that may be incorporated into white firelighter is variable and depends to some extent upon the ultimate use of the final composition, e.g. for readily igniteable fuels or for "hard" fuels.

For firelighters preferably 25 to 35% of granulated solid combustible material may be incorporated into white firelighter with concomitant reduction in liquid hydrocarbon content, although benefit is to be had in using smaller amounts such as 10% w/w or 15% w/w of the total composition which may be incorporated into white firelighter mixture with concomitant reduction in liquid hydrocarbon content.

The liquid hydrocarbons that may be employed are exemplified by petrol, gas oil and diesel oil, kerosine otherwise known as burning oil, paraffin or naphtha. Kerosine of boiling range 150°–260° C and flash point not less than 110° F is frequently employed. Part of the liquid fuel may be replaced by waste lubricating oil or suitable waxes, such as slack waxes, paraffin waxes, atactic polypropylene and polyethylene glycols.

White firelighter blocks of commerce usually contain about 85 percent w/w kerosine. Firelighter blocks in accordance with the present invention generally contain between 40 percent w/w and 60 per w/w of liquid hydrocarbon and even this may be partly replaced by waxes. Conveniently, about 55 percent w/w kerosine will be used.

As potentially thermosetting resins for use in the present invention there may be any or a mixture from a wide range of resins which are capable of thermosetting after the addition of hardening agents. Preferred resins are the urea-formaldehyde resins which require the addition of acids, or other substances giving rise to acid pH values in the presence of water, which cause the resins to become thermosetting. Suitable acids are, for instance, phosphoric acid, hydrochloric acid, sulphuric acid and salts of weak bases and strong acids such as ammonium chloride; alternatively blends of catalysts may be employed.

The curable resin is usually supplied in a fairly concentrated form, for example, 50 percent to 70 percent w/w solids solution. Combustible compositions in accordance with the present invention contain resin solids at up to 10 percent w/w, preferably 2 percent to 8 percent especially 3 percent to 6 percent w/w.

Of the base-catalysed resins that may be employed are phenol-formaldehyde resins, resorcinolformaldehyde resins. Suitable catalysts therefor include alkali metal hydroxides.

The firelighters of the present invention may contain flame control agents such as metal soaps. Extension of burning time may also be achieved with low concentrations, such as 0.5 percent w/w, of a very finely divided solid fuel, for example, particles that fall within the category of fines.

Salts of transition metals and oxygen rich compositions may be incorporated to assist in the ignition of hard fuels. Combustion catalysts, typically copper salts, such as cupric chloride or cupric oxychloride, which may be in hydrated forms may also be incorporated to improve the effectiveness of the final firelighter.

Such ignition catalysts may to advantage be coated onto or absorbed within the particulate solid combustible material prior to its incorporation. In this manner catalyst is released from the new surfaces of the granules as they gradually become exposed by combustion during a large fraction of the burning time.

The emulsion component may be foamed with air by agitating to increase bulk and assist burning. It an emulsion is to be foamed, preferably it is so-foamed prior to addition of the particles of solid combustible material.

In one aspect the invention includes a process for preparing the above firelighters. The firelighters may be prepared from a mixture of a suitable curable resin which may be in solution or dispersion together with surface active agent, emulsified hydrocarbon oil and solid combustible material in particulate form which is suspended in the emulsion, resin-cured catalyst and optionally additives to extend the burning time and/or combustion catalysts to enhance the ingitability of solid fuels.

White firelighter emulsion is prepared in known manner by rapid agitation of kerosine into a base containing urea-formaldehyde syrup, water and emulsifying agents. The emulsion produced is stable and passed to buffer storage.

By careful selection of particle size distribution as described above a stable peat/emulsion mixture can be produced. Further where fines (below 35 mesh) are included at a proper level and the size and character of the particles is correct the peat/emulsion mixture is stable for about 15 to 18 hours or more.

From storage, the emulsion is continuously pumped to a mixing chamber where particulate solid combustible material of the proper particle size is added in a continuous stream from a metering device. The particle size of the solid combustible material is critical as hereinbefore described and when the correct material is used the resultant mixture is stable for several hours. Furthermore, the mixture is no less convenient to handle than conventional white firelighter emulsions after the addition of catalyst and/or during curing.

The mixture of solid combustible material and the emulsion is then continuously delivered by a metering pump to a catalyst chamber which delivers a constant stream of curing catalyst solution. Finally, the catalysed mixture is rapidly fed into moulds to cure. The addition of catalyst is the last stage prior to final mixing so as to give optimum control of the post moulding handling procedure, that is cutting and packaging.

Final shaping of the combustible compositions may be executed via moulding or cutting or by suitable combinations of these operations.

The following are examples illustrative of the invention and in which all parts are parts by weight of the final composition:

EXAMPLE 1

The particulate solid fuel used was granulated peat, ground and screened to 8–22 mesh, the fines and coarse material (40%) being rejected. The compressed peat originates from peat briquette manufacture in which milled peat is further dried, cleaned, compressed at 5 ton p.s.i. and further dried to a moisture content of about 10%. Finally briquettes are comminuted and sieved.

An oil-in-water type emulsion was prepared by admixing:

59.0 parts — kerosine
8.5 parts — urea-formaldehyde (68 percent solids) resin dispersion supplied by Ciba-Geigy as Resin Aerolite FL2
1.0 parts — emulsifying agent, ARYLAN SEC 25, an aryl alkyl sulphonate supplied by LANKRO Chemicals Limited
6.0 parts — soft water The emulsion was storage-stable at ambient temperatures and capable of being kept as stock emulsion 25.0 parts of the peat and the above emulsion were blended continuously in a mixer and the mixture delivered to a pump then pumped to a catalyst chamber where 0.5 parts dilute hydrochloric acid catalyst was added to catalyse the mixture and the catalysed mixture was fed into moulds; when set sufficiently solid to handle gently, but not fully cured through curing of the resin, the blocks were dropped under the influence of gravity onto cutting wires arranged to produce firelighters of dimensions about 2.54 × 3.81 × 5.08 cm and weighing 50 g.

Compared with an equal weight of standard white firelighter of the same dimensions having composition:

84.0 parts — kerosine
6.0 parts — urea-formaldehyde resin (as above)
0.5 parts — emulsifying agent (as above)
9.0 parts — soft water
0.5 parts — dilute hydrochloric acid as catalyst the peat-containing firelighter was found to burn for 25 minutes whereas the standard firelighter burned for 14 minutes under the same conditions.

Comparative solid fuel ignition tests were conducted using standardised firelighting conditions, when 50 g of the above peat-containing firelighter kindled Welsh Dry Steam Coal; whereas 100 g of the standard white firelighter was needed to kindle the same quantity of Welsh Dry Steam Coal.

EXAMPLE 2

To an oil-in-water type emulsion prepared by admixing:

55 parts — kerosine
6.0 parts — urea-formaldehyde resin syrup as used in Example 1
0.5 parts — emulsifying agent as used in Example 1
8.5 parts — soft water was added 30 parts of peat as used in Example 1. This mixture was catalysed with 0.5 parts dilute hydrochloric acid and moulded into large blocks. On attaining green strength the large blocks were sliced and cut into firelighter blocks 3.04 × 2.9 × 6.3 cm and weighing 45 g.

In a test chamber these blocks burned for 25 minutes with a hot flame and after extinction of the flame continued to glow for a further 30 minutes with evolution of heat. By comparison, a commercially available white fireligher block containing 85 percent kerosine, but no peat, and of the same size and weight, in the same chamber burned for only 14 minutes with a vigorous flame and when this extinguished the residue did not glow or produce heat.

EXAMPLE 3

Three firelighter blocks each weighing 45 g were prepared as in Example 1 i.e. containing 59 percent w/w kerosine, using granulated peat of different particle size distributions viz:

Block 'A' — contained particles of mesh 6 to 16 (nominal sieve aperture sizes 2.8 mm and 1.0 mm respectively)
Block 'B' — contained particles of mesh 8 to 22 (Nominal sieve aperture sizes 2.0 mm and 710 μm respectively)
Block 'C' — contained particles of mesh 30 to 52 (nominal sieve aperture sizes 500 μm and 300 μm respectively)

The burning times for these blocks were measured under test conditions and compared with that obtained for a commercially available white firelighter of the same geometry containing 85 percent w/w kerosine but no peat (Block 'D').

The respective burning times were: Block 'A' - 22 minutes; Block 'B' — 26 minutes; Block 'C' was an unsatisfactory, wet block indicating that the emulsion had broken down to some extent during preparation and the block burned for 18 minutes with an unsatisfactory, smoky flame. Block 'D' burned for 14 minutes.

These tests show that by incorporating peat an extended burning time is obtained and provided that care is exercised in selecting the particle size a valuable product is produced.

The firelighters of the present invention, especially those containing granulated peat or wood of the proper particle size distribution show advantages over carbonaceous combustible materials both in processing and the final product. Carbonaceous combustible materials being the typical solid fuels such as coals and charcoal which are dirty to handle and moreover have not the same absorbency as peat and wood which property is believed to contribute to the burning characteristics of a firelighter of the present invention. Provided the correct smooth surface characteristic of the solid, non-carbonaceous materials is achieved little or no wetting of the surfaces of the particles occurs prematurely during processing yet a dry non-"weeping" product is obtained which does not exude moisture on storage.

What is now claimed is:

1. A solid combustible composition comprising:
(a) a hardened emulsion of a thermosetting resin and a hydrocarbon oil wherein said thermosetting resin forms a matrix and said hydrocarbon oil is dispersed throughout said matrix; and
(b) a particulate compressed peat material dispersed throughout said matrix wherein said peat material has a particle size such that at least 95% of said peat particles are retained on a sieve having a mesh number of 35 and a nominal aperture size of 0.44 mm.

2. The composition of claim 1, wherein said oil is dispersed throughout said matrix in the form of globules.

3. The composition of claim 1, wherein said particulate peat is peat which has been formed by comminuting compressed peat.

4. The composition of claim 3, further comprising up to 1% of a substance to extend burning time.

5. The composition of claim 4 wherein said substance is selected from the group comprising: talc, a metal soap and ultra fine particles of the solid combustible material.

6. The composition of claim 3 wherein said comcomposition comprises a combustion catalyst.

7. The composition of claim 6 wherein said combustion catalyst is located towards the surface of the particles.

8. The composition of claim 6 wherein said combustion catalyst is selected from the group consisting of cupric chloride, cupric oxychloride and hydrates thereof in a finely divided state.

9. The composition of claim 3, wherein said hydrocarbon oil is kerosene.

10. The composition of claim 3, wherein said peat is dried and agglomerated with an agglomerating agent prior to being compressed.

11. The composition of claim 3 wherein said dried peat is compressed in a ratio of at least 4:1.

12. The composition of claim 11 wherein said peat is present in at least 5% by weight of the total composition.

13. The composition of claim 3, wherein at least 95% of said peat is retained on a screen having a mesh number of 35 and a nominal aperture size of 0.44 mm.

14. The composition of claim 3, wherein said composition comprises 25% w/w to 35% w/w compressed peat.

15. The composition of claim 3, wherein the particle size distribution is such that the particles are retained on at least one sieve of mesh number of 5 through 22 having a nominal aperture size of between 3.35 mm and 710 mm respectively and wherein said composition comprises 40% to 60% w/w hydrocarbon oil, up to 10% w/w resin solids and up to 20% w/w water.

16. The particulate peat of claim 3 wherein said peat has a density of 0.64 to 0.72 g/ml.

17. The composition of claim 1 wherein said peat is present in at least 5% by weight of the total composition.

18. The composition of claim 1, wherein said thermosetting resin is a urea-formaldehyde resin.

19. The composition of claim 1, wherein said thermosetting resin has been aerated prior to curing.

20. The composition of claim 1 wherein said particles are retained on at least one sieve having a mesh number of 5 to 22 and nominal apertures of 3.35 mm. to 710 mm. respectively.

21. The composition of claim 1 wherein said particles are retained on at least one sieve having mesh numbers of 7 through 14 and nominal apertures of 2.4 mm. to 1.18 mm. respectively.

22. A solid combustible composition comprising:
(a) a hardened emulsion of a thermosetting resin and a hydrocarbon oil, wherein said thermosetting resin forms a matrix and said hydrocarbon oil dispersed throughout said matrix; and
(b) a compressed particulate wood material dispersed throughout said matrix wherein said particulate wood is of such a size that at least 95% of said particles are retained on a sieve of mesh number 35 having a nominal aperture size of 0.44 mm.

23. The composition of claim 22, wherein said compressed particulate wood material is made by comminuting compressed wood.

24. The composition of claim 22, wherein said particulate wood is of such a size that at least 90% of said particles are retained on sieve meshes number 5 to 22 having nominal aperture sizes of 3.35 mm. to 0.71 mm. respectively.

25. The composition of claim 22, wherein said wood comprises 25% w/w to 35% w/w of said composition.

26. A process for producing a combustible composition comprising the steps of:
(a) forming an oil-in-water emulsion out of a hydrocarbon oil, a curable thermosetting resin, an emulsifying agent and water;
(b) mixing said emulsion with a material comprising a particulate material from the group consisting of: peat, compressed peat and compressed wood, wherein at least 95% of said particulate material is retained on a 35 mesh number sieve having a nominal aperture size of 0.44 mm; and
(c) catalyzing said emulsion of step b) to cure said resin.

27. The process of claim 26, wherein said catalyst is added to said mixture after adding said particulates such that substantial setting of said particulate material by said emulsion components is avoided.

28. The process of claim 27, wherein said catalyst is an acid catalyst.

29. The process of claim 26, wherein said mixture of hydrocarbon oil, resin, water and emulsifying agent is aerated prior to the addition of said particulate material.

* * * * *

UNITED STATES PATENT OFFICE

CERTIFICATE OF CORRECTION

Patent No. 4,083,697 Dated April 11, 1978

Inventor(s) Smith et al

It is certified that error appears in the above-identified patent and that said Letters Patent are hereby corrected as shown below:

IN THE SPECIFICATION:

Column 4, line 42, change "It" to --If--.

Column 4, line 51, change "resin-cured" to --resin-cure--.

Column 4, line 53, change "ingitability" to --ignitability--.

IN THE CLAIMS:

Claim 6, column 7, lines 28-29, change "comcomposition" to --composition--.

Claim 22, column 8, line 21, after "oil" insert --is--.

Signed and Sealed this

*Fourteenth* Day of *November 1978*

[SEAL]

*Attest:*

RUTH C. MASON
*Attesting Officer*

DONALD W. BANNER
*Commissioner of Patents and Trademarks*

UNITED STATES PATENT OFFICE

CERTIFICATE OF CORRECTION

Patent No. 4,083,697 Dated April 11, 1978

Inventor(s) Smith et al.

It is certified that error appears in the above-identified patent and that said Letters Patent are hereby corrected as shown below:

Column 8, line 44, change "from" to --selected from--.

Signed and Sealed this

*Twentieth* Day of *November 1979*

[SEAL]

*Attest:*

RUTH C. MASON
*Attesting Officer*

LUTRELLE F. PARKER
*Acting Commissioner of Patents and Trademarks*